United States Patent [19]

Dobrusskin et al.

[11] Patent Number: 4,717,852

[45] Date of Patent: Jan. 5, 1988

[54] LOW-POWER, HIGH-PRESSURE DISCHARGE LAMP

[75] Inventors: Alexander Dobrusskin, Taufkirchen; Jürgen Heider; Achim Gosslar, both of Munich, all of Fed. Rep. of Germany

[73] Assignee: Patent-Treuhand-Gesellschaft für elektrische Glühlampen mbH, Munich, Fed. Rep. of Germany

[21] Appl. No.: 802,073

[22] Filed: Nov. 26, 1985

Related U.S. Application Data

[63] Continuation of Ser. No. 515,387, Jul. 20, 1983, abandoned.

[30] Foreign Application Priority Data

Aug. 30, 1982 [DE] Fed. Rep. of Germany ..... 3232207

[51] Int. Cl.[4] ..... H01J 61/34

[52] U.S. Cl. ..... 313/25; 313/112; 313/523; 313/634

[58] Field of Search ..... 313/25, 523, 634, 636, 313/642, 112, 113, 579, 580, 559, 558, 560, 635, 671, 676

[56] References Cited

U.S. PATENT DOCUMENTS

| | | | |
|---|---|---|---|
| 2,304,412 | 12/1942 | Kern | 313/559 |
| 3,479,548 | 11/1969 | Schlessel | 313/25 X |
| 3,555,336 | 1/1971 | Koedam | 313/112 |
| 3,676,729 | 7/1972 | Menelly | 313/635 |
| 3,781,586 | 12/1973 | Johnson | 313/570 |
| 4,199,701 | 4/1980 | Pattacharya | 313/25 |
| 4,321,504 | 3/1982 | Keeffe | 313/25 |
| 4,338,540 | 7/1982 | Sovilla | 313/112 |
| 4,370,587 | 1/1983 | Notelteirs | 313/113 |
| 4,380,714 | 4/1983 | Pouman | 313/559 |
| 4,499,396 | 2/1985 | Fohl | 313/25 |

FOREIGN PATENT DOCUMENTS 1557731 12/1979 United Kingdom .

*Primary Examiner*—Kenneth M. Schor

*Attorney, Agent, or Firm*—Frishauf, Holtz, Goodman & Woodward

[57] ABSTRACT

Low-power lamps, that is, lamps having a power rating of less than 250 W, e.g. less than 100 W, and, for instance 40 W, have an arc tube which has a fill of mercury with additives of metal halides and a noble gas. To permit universal mounting application of the lamp, the arc tube (2) has a single-press seal (3) at one side thereof in which the electrodes are retained, the arc tube being surrounded by an envelope having, likewise, a single-ended, single-press seal (5) located at the same side as the press seal of the arc tube, through which continuation elements (8, 10, 12, 14; 9, 11, 13, 15) of the electrode elements are conducted. The arc tube and the envelope are so closely spaced that heat radiated from the arc tube to the envelope is effectively reflected to the arc tube without substantial radiation by the envelope. The arc tube and/or the envelope may be frosted, and made, respectively, of hard glass or quartz glass which has low transmissivity in the UV and IR ranges of radiation.

20 Claims, 3 Drawing Figures

LOW-POWER, HIGH-PRESSURE DISCHARGE LAMP

This application is a continuation of application Ser. No. 515,387, filed July 20, 1983, now abandoned.

The present invention relates to a high-pressure discharge lamp which has a discharge vessel of high heat-resistant material, for example and preferably quartz glass, a fill of mercury, with additives of metal halides and a noble gas, and which is surrounded by an outer envelope, and more particularly to a lamp of this type of low power, for example in the range of 250 W and less, e.g. substantially less than 100 W.

BACKGROUND

Wider utility of high-pressure discharge lamps having a metal halide fill can be obtained by decreasing the power input to the lamps, so that the field of use can be extended. Lamps of this type can then also be used for home, office, and other work-place illumination. The lamps should be compatible with existing supply networks and must have particularly desirable firing or ignition as well as operating characteristics, compatible with replacement of ordinary incandescent or fluorescent lamps in illumination circuits.

U.S. Pat. No. 4,199,701, BHATTACHARYA, (assigned General Electric) described a metal halide, high-pressure lamp located within an exterior vessel or bulb, in which a miniaturized discharge vessel or bulb, that is, having a volume of less than 1 $cm^3$, is used. The electrodes are introduced through respective opposite ends of the discharge vessel—so that it will be a double-ended bulb—being melted through press ends of the discharge vessel. The discharge vessel is held by a support structure which is carried at the press stem secured to a contact base, for example of the screw-in type, and which also supports the outer envelope of the lamp.

In order to obtain desirable ignition and operating characteristics, a penning mixture of neon admixed with argon, crypton or xenon is used. To decrease loss of neon by diffusion from the arc tube or actual discharge vessel, the outer bulb retains a neon filling.

Metal halide high-pressure discharge lamps of low power are also described in the referenced U.S. Pat. No. 4,321,504, KEEFFE et al (assigned GTE Products Corp.) and have a single-ended arc tube or discharge vessel in which two electrodes are melted through a single press stem. There is no disclosure relating to an outer envelope or bulb in this structure. To obtain desirable increase in the lifetime of the lamp, the distance between the electrodes and the adjacent surfaces of the arc tube should have a certain dimension, as described.

THE INVENTION

It is an object to provide a high-pressure discharge lamp of low power having a metal halide fill which will fire or ignite even at relatively low voltages with speed and rapidity, even when hot, and which can be operated independently of position of the lamp with respect to gravity. The lamp, additionally, should be simple to construct.

Briefly, the bulb or arc tube has a single press or pinch seal at one side thereof, through which the electrodes leading into the arc tube are conducted. An envelope surrounds the bulb which, likewise, is single-ended and has a single press seal at the same side as the bulb. The envelope surrounds the bulb with a spacing which is so small that heat radiated from the bulb to the envelope is effectively reflected back to the bulb without substantial radiation from the envelope.

High-pressure discharge lamps having a fill of metal halides, particularly lamps of low power, for example of 250 W or less, and, especially, of 100 W or less, require an especially good heat retention capability in order to have high efficiency, that is, a high ratio of light radiation with respect to electrical power being consumed and, further, in order to be independent of the position of the arc tube or inner vessel while insuring stable operation. It is necessary to keep losses, which arise by radiation or conduction of energy which is not converted into visible light, as low as possible.

The lamps in accordance with the present invention can be operated at power between 30 W and 50 W, and for such low-power lamps it is particularly important to have an appropriate heat retention or heat balance capability in order to insure reproducible operating data, especially with respect to color temperature and ignition or firing characteristics.

To obtain excellent heat balance and control of heat losses, the distance between the arc tube or discharge vessel and the outer bulb is selected to be as small as possible. In accordance with a feature of the invention, therefore, the distance between the arc tube and the surrounding bulb or vessel is so selected that effective back or re-radiation is obtained to the arc tube in accordance with the Stephan-Boltzmann law,—$T^4$.

In accordance with a feature of the invention, it is possible to keep the distance between the arc tube and the outer envelope or bulb particularly small by so constructing the lamp that the arc tube as weel as the outer bulb have only a single press melt for both electrodes or, respectively, for both current supply lines, and so arranging the position of the arc tube in the bulb that the press or pinch seals, through which the electrodes are melted, are facing in the same direction. This construction eliminates the necessity for a complex internal support structure in the lamp, and permits formation of a sealed tight arrangement between the inner arc tube and the surrounding vessel, as well as with respect to surrounding atmosphere. Press melt connections are particularly desirable since they take up less space—with respect to base press stems—and are easier to manufacture.

The discharge arc will extend between the electrodes transverse to the feed-through press melt when the discharge vessel is a single-ended vessel having only a single press. Thus, in contrast to a double-ended press, the heating of the vessel will be substantially more uniform. The coldest spots of the discharge vessel will have a higher temperature with a single-ended construction and, in addition to increase of vapor pressure, will result in an increase in vapor density, which increased the light output for a given input, and thus the light output efficiency. It is then no longer necessary to provide mirror or reflecting surfaces at the end portion of the discharge vessel.

In accordance with a feature of the invention, the fill preferably includes sodium in order to obtain a warm light output. Loss of sodium ions from the arc tube or discharge vessel can be effectively prevented by elimination of the previously customary support structure, in which metal elements were carried outside of the arc tube close thereto. Lamps having metal components within the external surrounding bulb or envelope release electrodes due to the short-wave ultraviolet (UV)

radiation of the discharge, which may lead to a diffusion of sodium ions from the discharge vessel.

In accordance with a preferred feature of the invention, the arc tube or discharge vessel is made of quartz glass and has a frosted or matted surface. The arc tube will heat more uniformly when frosted. This, additionally, results in retaining the photometric and electrical data essentially constant, regardless of the operating position of the lamp. Investigation has shown that the color composition of the light output of the lamp remains essentially stable.

The outer envelope or bulb surrounding the arc tube or discharge vessel is preferably made of quartz glass or hard glass which also may be frosted. This results in increased reradiation or back-radiation towards the discharge vessel, additionally increasing heating thereof.

In accordance with a feature of the invention, both the arc tube or discharge vessel and/or the outer envelope or outer bulb may be made of a quartz glass or hard glass composition, for example, of quartz glass, with additives of $TiO_2$ or $CeO_2$, which has only low tranmissivity in the UV range of radiation. A greater proportion of the UV radiation generated in the arc tube will be retained by the above-mentioned oxide additives. This decreases energy losses and a further improvement in the heat retention is obtained.

Heat retention or thermal economy additionally can be obtained by constructing the arc tube or discharge vessel and/or the outer envelope or bulb with a quartz or hard glass substance which has low transmissivity in the infrared (IR) range of radiation. Absorption of IR radiation within the glass of the outer vessel, however, may be only to the extent that it does not lead to softening of the glass material. If necessary, the outer bulb or envelope may receive an IR reflective coating, for example a tin-oxide layer doped with indium. Combination of any of the above-described features is, of course, possible, for example forming the discharge vessel of quartz glass with low transmissivity of UV radiation, and the outer bulb or envelope of quartz or hard glass with low transmissivity in the IR range.

The space between the outer bulb and the discharge vessel, preferably, is evacuated in order to effectively prevent conduction of heat from the arc tube to the outside.

A getter, preferably of a zirconium alloy, can be a located within the bulb or envelope in order to eliminate any possible contaminants. The getter material may be applied to a holder, for example a support wire which is included in the press fit without electrical galvanic connection, so that it is retained free from electrical voltage in the respective press. It can be held in the press of the arc tube or discharge vessel or in the press of the outer bulb or envelope.

The electrodes, preferably, have a shaft and a spiral twist portion. Adjacent windings of the twist or filament portion are so arranged that they do not touch each other. They are angled off with respect to the shaft element by about 90°. These electrodes have excellent arc-transfer characteristics and effectively prevent blackening of the discharge vessel. This structure results in optimum firing or ignition of the lamp, even when hot.

The discharge vessel, preferably, includes sodium in order to provide a warm light color. This is desirable when the lamp is to be used for home or general service illumination, in offices, factories, and the like. A composition of fill has been found particularly suitable in which, besides mercury and a noble gas, the inner volume includes 3 to 50 μmol sodium halide, 3 to 50 μmol (II)-halide, and 0.3 to 4.5 μmol thallium halide—all per $cm^3$ of the inner volume of the arc tube.

DRAWINGS

DETAILED DESCRIPTION

Figure 1:
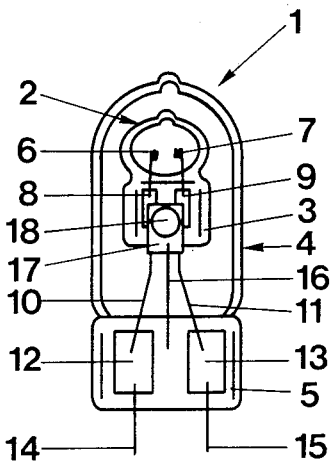
FIG. 1 is a schematic front view of the lamp, without a base attached.
Figure 3:
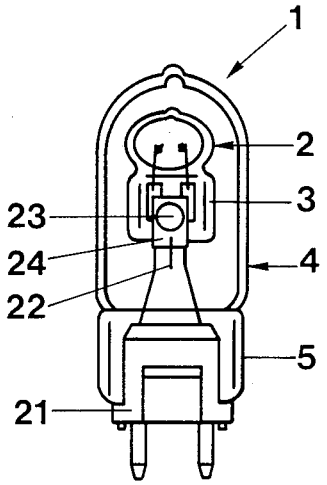
FIG. 3 is a schematic front view of the lamp with a base attached thereto.
Figure 2:
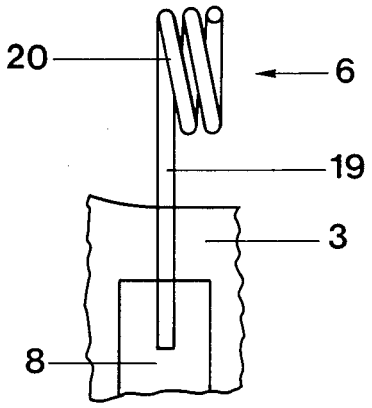
FIG. 2 is a schematic front view of the electrode of the lamp of FIG. 1.

The lamp 1 shown in FIGS. 1–3 is a 40 W high-pressure discharge lamp. It has a single-ended press discharge vessel 2 made of quartz glass. The entire outer surface—including the press 3 thereof—is frosted. An outer envelope or bulb 4, also of quartz glass, with a press 5 surrounds the arc tube 2.

The electrodes 6, 7—schematically shown in FIG. 1—are melted through the press 3 by molybdenum foils 8, 9. The current supply leads 10, 11, made of tungsten, and connected to the foils 8, 9, support the arc discharge tube 2. They are, in turn, melted through the press 5 with the molybdenum foils 12, 13. Current supply leads 14, 15 are made of tungsten, and connected to the foils 12, 13, to provide electrical power to the lamp 1.

The press 5 of the outer envelope 4 has a support wire 16 melted therein, without connection to any one of the other current supply leads. Supply wire 16 supports a small metal plate 17 which forms the getter holder. The getter material 18 preferably is a zirconium alloy, present in a quantity of for example about 25 mg.

The interior volume of the arc tube 2 is 0.2 $cm^3$. The fill within the arc tube is 0.3 mg NaI, 0.75 mg $SnI_2$, 0.06 mg TlI and 8 mg Hg. Argon is used as the igniter gas, at a pressure of 100 mbar, due to the short electrode distance of the electrodes which may be between 4 to 5 mm. This high pressure is substantially over the 30 to 50 mbar customary in high-pressure discharge lamps with halide fill. The high pressure further improves transfer of the arc between the electrodes.

One of the electrodes, electrode 6, is shown in FIG. 2. Construction of the electrode 7 is identical, and mirror-symmetrical with respect to electrode 6. Electrode 6 is made of a single wire element having 0.25 mm diameter. The wire is formed to have a shaft portion 19 and a twist portion 20. The twist portion 20 is angled off with respect to the shaft portion 19 by 90°. The twist or spiral portion has $2\frac{1}{4}$ windings with an inner diameter of 0.3 mm, the windings being spaced from each other by 0.1 mm. The electrode 6 is made of tungsten, enriched with 0.7% thorium oxide. It does not include an emitter.

The lamp 1'—as best seen in FIG. 3—is mounted in a pin socket 21. The press end of the outer envelope 4, that is, the press 5, is fitted into the pin socket 21. The remaining structure of lamp 1' is similar to that of FIG. 1, except that the arrangement of the getter wire 22 is different. The getter wire 22, carrying the getter material 23 on a metal plate 24, is melted into the press 3 of the discharge vessel 2. The melt-in into the press is not visible in FIG. 3, being positoned behind the metal plate 24.

Example of electrical and optical data of a 40 W lamp:

power: 40 W arc voltage: 80 V
lamp current: 0.6 A
power factor: 0.85
light output: 2500 lm
light efficiency: approx. 61 lm/W
color temperature: 3200° K.
color rendition Ra: 76
fill: 10 μmol sodium halide;10 μmol tim (II)—halide and 0.9 μmol thallim halide and 40 mg Hg and argon at pressure of 100 mbar—all per $cm^3$ of the inner volume of the arc tube.

Lamps of this general type will have light yield of about 60 lm/W, with a color index of about 75.

Various changes and modifications may be made within the scope of the inventive concept.

Examples of pinch or press seals and/or their manufacture are described in U.S. Pat. Nos. 3,319,906, Fix et al; 3,742,283, Loughridge; and 4,307,718, Nixon.

We claim:

1. Low-power, high pressure single based discharge lamp (1,1') having
an outer envelope (4) consisting of a single closed envelope wall having a first end facing in a first direction and a second end facing in an opposite direction;
an arc tube (2) of highly heat-resitant material located within the single envelope wall having a first end facing in said first direction and a second end facing in said opposite direction;
a filling, within the arc tube, including mercury and additives comprising at least one metal halide and at least one noble gas;
a single arc tube pinch or press seal (3) formed on the arc tube;
two electrodes (6,7) tightly sealed in the arc tube;
two electrode current supply metal leads (8, 10, 12, 14; 9, 11, 13, 15) each lead being connected to an electrode, said leads being melted through the single arc tube pinch or press seal of the arc tube and sealed therein, said electrode current supply leads comprising highly heat-resistant material; and wherein
the outer envelope (4) includes a single envelope pinch or press eal (5), forming a base for said single base lamp;
the arc tube pinch or press seal (3) and the single envelope pinch or press seal (5) both being located at the first end of the arc tube and envelope respectively and both being outwardly directed from the arc tube and envelope respectively;
the electrode current supply leads (8, 10; 9, 11) extending outwardly through the arc tube pinch or press seal (3) and directly into said envelope pinch or press seal (5) and are sealed therein, and have portions (14, 15) which extend outwardly of the envelope pinch or press seal (5);
the single closed envelope wall of the outer envelope (4) is of hgh heat resistant glass and surrounds the arc tube with a spacing which is so small that heat radiated from the arc tube to the envelope is effectively reflected to the arc tube without substantial heat radiation outwardly from the envelope; and
said outer envelope (4) is tipped off at an end of said single based lamp remote from said envelope pinch or press seal (5).

2. Lamp according to claim 1, wherein the arc tube (2) is frosted.

3. Lamp according to claim 1, wherein outer envelope (4) is frosted.

4. Lamp according to claim 2, wherein the outer envelope (4) is frosted.

5. Lamp according to claim 1, wherein at least one of: said arc tube (2); said outer envelope (4)
is made of quartz glass or hard glass material having low ultraviolet radiation transmissivity.

6. Lamp according to claim 1, wherein at least one of: said arc tube (2);
said outer envelope (4)
is made of quartz glass or hard glass material which has low infrated radiation transmissivity.

7. Lamp accirding to claim 6, wherein the outer envelope (4) includes an infrated radiation reflecting coating.

8. Lamp according to claim 1, wherein the space between the arc tube (2) and the outer envelope (4) is evacuated.

9. Lamp according to claim 1, further including a getter holder support (22) melted through the press seal (3) of the arc tube (2) and galvanically insulated from said electrodes.

10. Lamp according to claim 1, further including a getter holder support (16) melted through the press seal (5) of the outer envelope (4) and galvanically insulated from the electrodes.

11. Lamp according to claim 1, wherein the electrodes comprise a shaft element (19) secured to the press seal (3) of the arc tube, and a spiral or twist portion (20),
adjacent windings of the spiral or twist portion (20) are spaced from each other, and the spiral or twist portion is angled with respect to the shaft portion (19) by about 90°.

12. Lamp according to claim 1, wherein the filling of the metal halide within the arc tube (2) includes sodium.

13. Lamp according to claim 1, wherein the arc tube (2), per $cm^3$ interior volume, includes
3 to 50 μmol sodium halide;
3 to 50 μmol tin (II)-halide;
0.3 to 4.5 μmol thallium halide.

14. Lamp according to claim 10, wherein, per cubic centimeter interior volume of the arc tube (2), the filling includes 10 μmol sodium halide, 10 μmol tin (II), halide, and 0.9 μmol thallium halide.

15. Lamp according to claim 11, wherein the lamp is a nominally 40 W lamp;
the terminal portions of the electroides are spaced from each other by between about 4 to 5 mm;
the arc tube has an interior volume of 0.2 $cm^3$, and the filling comprises
0.3 mg NaI
0.75 mg $SnI_2$
0.06 mg TlI
8 mg Hg,
and including argon at a pressure of 100 mbar.

16. Lamp according to claim 15, wherein at least one of: the arc tube (2); the outer envelope (4) is frosted;
wherein at least one of: said outer arc tube (2); said envelope (4) is made of quartz glass or hard glass material having low ultraviolet radiation transmissivity;
and wherein at least one of: said arc tube (2); said outer envelope (4) is made of quartz glass or hard glass material which has low infrated radiation transmissivity.

17. Lamp according to claim 1, wherein at least one of: the arc tube (2), the outer envelope (4) is frosted;

wherein at least one of: said are tube (2); said outer envelope (4) is made of quartz glass or hard glass material having low ultraviolet radiation transmissivity;

wherein at least one of: said arc tube (2); said outer envelope (4) is made of quartz glass or hard glass material which has low infrared radiation transmissivity; and further including a getter holder support (16) melted through the press seal (5) of the envelope (4) and galvanically insulated from the electrodes.

18. Lamp according to claim 17, further including argon at a pressure of 100 mbar within the interior of the arc tube.

19. Lamp according to claim 18, wherein the outer envelope (4) includes an infrared radiation reflecting coating.

20. Lamp according to claim 1 wherein the filling of the arc tube has a pressure substantially exceeding 50 millibars.

* * * * *